US008177921B2

(12) United States Patent
Odaka et al.

(10) Patent No.: US 8,177,921 B2
(45) **Date of Patent: *May 15, 2012**

(54) R-FE-B RARE EARTH SINTERED MAGNET

(75) Inventors: Tomoori Odaka, Osaka (JP); Hideyuki Morimoto, Osaka (JP); Kohshi Yoshimura, Osaka (JP); Shigeru Takaki, Osaka (JP); Shinichiro Sakashita, Osaka (JP)

(73) Assignee: Hitachi Metals, Ltd., Tokyo (JP)

( * ) Notice: Subject to any disclaimer, the term of this patent is extended or adjusted under 35 U.S.C. 154(b) by 134 days.

This patent is subject to a terminal disclaimer.

(21) Appl. No.: 12/670,718

(22) PCT Filed: Jul. 25, 2008

(86) PCT No.: PCT/JP2008/001996

§ 371 (c)(1),
(2), (4) Date: Jan. 26, 2010

(87) PCT Pub. No.: WO2009/016815

PCT Pub. Date: Feb. 5, 2009

(65) Prior Publication Data

US 2011/0012699 A1 Jan. 20, 2011

(30) Foreign Application Priority Data

Jul. 27, 2007 (JP) ..... 2007-196159

(51) Int. Cl.
*H01F 1/057* (2006.01)

(52) U.S. Cl. ..... 148/302; 148/101; 148/122

(58) Field of Classification Search ..... None
See application file for complete search history.

(56) References Cited

U.S. PATENT DOCUMENTS

| | | | |
|---|---|---|---|
| 5,383,978 | A | 1/1995 | Yamamoto et al. |
| 6,319,336 | B1 | 11/2001 | Kamada et al. |
| 6,468,365 | B1 | 10/2002 | Uchida et al. |
| 7,064,642 | B2 | 6/2006 | Komuro et al. |
| 2003/0145910 | A1 | 8/2003 | Mochizuki et al. |
| 2004/0050454 | A1 | 3/2004 | Sekino et al. |

(Continued)

FOREIGN PATENT DOCUMENTS

| | | | |
|---|---|---|---|
| EP | 0 237 416 | A1 | 9/1987 |

(Continued)

OTHER PUBLICATIONS

Official Communication issued in International Patent Application No. PCT/JP2008/001996, mailed on Nov. 4, 2008.

(Continued)

*Primary Examiner* — John Sheehan
(74) *Attorney, Agent, or Firm* — Keating & Bennett, LLP

(57) ABSTRACT

An R—Fe—B based rare-earth sintered magnet according to the present invention includes, as a main phase, crystal grains of an $R_2Fe_{14}B$ type compound that includes Nd, which is a light rare-earth element, as a major rare-earth element R. The magnet includes a heavy rare-earth element RH (which is at least one of Dy and Tb) that has been introduced through the surface of the sintered magnet by diffusion. The magnet has a region in which the concentration of the heavy rare-earth element RH in a grain boundary R-rich phase is lower than at the surface of the crystal grains of the $R_2Fe_{14}B$ type compound but higher than at the core of the crystal grains of the $R_2Fe_{14}B$ type compound.

4 Claims, 2 Drawing Sheets

U.S. PATENT DOCUMENTS

| | | | | |
|---|---|---|---|---|
| 2006/0278517 | A1 | 12/2006 | Machida et al. | |
| 2007/0034299 | A1 | 2/2007 | Machida et al. | |
| 2008/0223489 | A1 * | 9/2008 | Nagata et al. | 148/101 |
| 2008/0286595 | A1 * | 11/2008 | Yoshimura et al. | 428/548 |
| 2009/0020193 | A1 * | 1/2009 | Ohta et al. | 148/559 |
| 2010/0182113 | A1 * | 7/2010 | Yoshimura et al. | 335/302 |
| 2010/0231338 | A1 * | 9/2010 | Morimoto et al. | 335/302 |
| 2011/0012699 | A1 * | 1/2011 | Odaka et al. | 335/302 |
| 2011/0205006 | A1 * | 8/2011 | Odaka et al. | 335/302 |

FOREIGN PATENT DOCUMENTS

| | | | |
|---|---|---|---|
| EP | 1 643 513 | A1 * | 4/2006 |
| EP | 1 860 668 | A1 | 11/2007 |
| EP | 1 879 201 | A1 | 1/2008 |
| EP | 1 981 043 | A | 10/2008 |
| EP | 1 993 112 | A1 * | 11/2008 |
| EP | 2 169 689 | A1 | 3/2010 |
| JP | 05-047533 | A | 2/1993 |
| JP | 2001-284111 | A | 10/2001 |
| JP | 2005-209669 | A | 8/2005 |
| JP | 2007-258455 | A | 10/2007 |
| JP | 2007-273815 | A | 10/2007 |
| JP | 2007-288020 | A | 11/2007 |
| JP | 2007-288021 | A | 11/2007 |
| JP | 2007-329331 | A | 12/2007 |
| WO | 2007/102391 | * | 9/2007 |

OTHER PUBLICATIONS

English translation of Official Communication issued in corresponding International Application PCT/JP2008/001996, mailed on Feb. 18, 2010.

Official Communication issued in corresponding European Patent Application No. 08776893.3, mailed on Jul. 14, 2011.

* cited by examiner

R-FE-B RARE EARTH SINTERED MAGNET

TECHNICAL FIELD

The present invention relates to an R—Fe—B based rare-earth sintered magnet including crystal grains of an $R_2Fe_{14}B$ type compound (where R is a rare-earth element) as a main phase and a method for producing such a magnet. More particularly, the present invention relates to an R—Fe—B based rare-earth sintered magnet, which includes Nd, a light rare-earth element, as a major rare-earth element R and in which a portion of the rare-earth element R is replaced with a heavy rare-earth element RH (which is at least one of Dy and Tb).

BACKGROUND ART

An R—Fe—B based rare-earth sintered magnet, including an $Nd_2Fe_{14}B$ type compound phase as a main phase, is known as a permanent magnet with the highest performance, and has been used in various types of motors such as a voice coil motor (VCM) for a hard disk drive and a motor for a hybrid car and in numerous types of consumer electronic appliances. It is already known, however, that an R—Fe—B based rare-earth sintered magnet will cause an "irreversible flux loss" (i.e., a phenomenon that a magnet will lose more and more magnetism thereof as the temperature rises). For that reason, when used in a motor, for example, the magnet should maintain coercivity that is high enough even at elevated temperatures to minimize the irreversible flux loss. To realize that, the coercivity of the magnet at an ordinary temperature needs to be increased or the absolute value of the rate of variation in coercivity to a required temperature (i.e., the temperature coefficient of the coercivity) needs to be decreased.

It has been known that if the rare-earth element R in the $R_2Fe_{14}B$ phase is replaced with a heavy rare-earth element RH (which may be Dy and/or Tb), the coercivity will increase. In that case, the temperature coefficient of the coercivity also increases proportionally to the percentage of the rare-earth element R replaced by the heavy rare-earth element RH. That is why it has been believed to be effective to add such a heavy rare-earth element RH as much as possible to achieve high coercivity at a high temperature.

Among other things, since the magnetocrystalline anisotropy of $Tb_2Fe_{14}B$ is approximately 1.5 (=3/2) times as high as that of $Dy_2Fe_{14}B$, the coercivity and the temperature coefficient of the coercivity can be increased more efficiently with Tb than with Dy.

However, the magnetic moments of the heavy rare-earth element RH in the $R_2Fe_{14}B$ phase and Fe have mutually opposite directions. That is why the greater the percentage of the light rare-earth element RL (which may be at least one of Nd and Pr) replaced with the heavy rare-earth element RH, the lower the remanence $B_r$ would be. Furthermore, as the heavy rare-earth element RH is one of rare natural resources, its use is preferably cut down. For these reasons, the coercivity of a rare-earth magnet should be increased effectively with the addition of as small an amount of the heavy rare-earth element RH as possible.

Patent Document No. 1 discloses that by adjusting the ratios of the light and heavy rare-earth elements RL and RH and the mole fraction of another constituent element of an R—Fe—B based rare-earth magnet within predetermined ranges, the temperature coefficient of the R—Fe—B based rare-earth magnet will increase.

Patent Document No. 2 teaches raising the temperature, at which the percentage of the irreversible flux loss of an R—Fe—B based rare-earth magnet reaches 5%, by 30° C. or more compared to the conventional technique by carrying out aging treatment in two stages after the sintering process.

Patent Document No. 3 discloses that by making an R—Fe—B based rare-earth magnet of a mixture of a hard magnetic material power, including a rare-earth element, and a diamagnetic material powder, magnetic coupling will be produced between the hard magnetic material powder and the diamagnetic material power, thus reducing the absolute value of the temperature coefficient of the R—Fe—B based rare-earth magnet.

Patent Document No. 4 teaches how to increase the magnetic transformation temperature and the temperature coefficient by adding a ferromagnetic fluorine compound to an R—Fe—B based rare-earth magnet.

Patent Document No. 5 discloses that if a rare-earth-iron-boron based magnet is held in a pressure-reduced chamber so that an element M (which is one, two or more rare-earth elements selected from the group consisting of Pr, Dy, Tb and Ho), which has turned into vapor or fine particle by some physical technique, or an alloy including such an element M, is deposited to form a film on the surface of a magnet and then caused to diffuse and permeate, a crystal grain boundary layer, including plenty of the element M, is formed. In that case, even if the concentration of the rare-earth element such as Dy were reduced, a high-performance magnet with high coercivity or high remanence could still be obtained according to Patent Document No. 5.

Patent Document No. 1: Japanese Patent Application Laid-Open Publication No. 2001-284111

Patent Document No. 2: Japanese Patent Application Laid-Open Publication No. 5-47533

Patent Document No. 3: Japanese Patent Application Laid-Open Publication No. 2004-79922

Patent Document No. 4: Japanese Patent Application Laid-Open Publication No. 2005-209669

Patent Document No. 5: Japanese Patent Application Laid-Open Publication No. 2005-11973

DISCLOSURE OF INVENTION

Problems to be Solved by the Invention

A magnet for use in motors for EPS (electric power steering) cars and HEVs (hybrid electric vehicles), which will be in growing demand in the near future, should have coercivity that is high enough to avoid the irreversible flux loss at elevated temperatures of 100° C. or more. For that reason, a heavy rare-earth element RH is added to increase the coercivity at an ordinary temperature or the temperature coefficient of the coercivity. However, since the heavy rare-earth element RH (which may be Dy and/or Tb) is one of rare natural resources, its use should be cut down as much as possible.

None of Patent Documents Nos. 1 to 4 cited above teaches how to get the heavy rare-earth element RH, which has been introduced into the magnet, distributed efficiently. That is to say, these documents neither teach nor suggest how to realize a magnet structure that can reduce the temperature dependence of the coercivity $H_{cJ}$ while decreasing the concentration of the heavy rare-earth element RH to as low a level as possible.

Specifically, according to the technique disclosed in Patent Document No. 5, there should be a significant RH concentration difference to diffuse the heavy rare-earth element RH inside the magnet, and therefore, it is difficult to supply a sufficient amount of RH to the outer periphery (surface region) of the main phase grains inside the magnet. On top of that, a lot of the heavy rare-earth element RH, which does not contribute to increasing the coercivity, will be left in the grain boundary phase of the resultant magnet. Consequently, the cost of making such a magnet is too high for its actual performance as a magnet.

It is therefore an object of the present invention to provide an R—Fe—B based rare-earth sintered magnet that has good temperature properties.

Means for Solving the Problems

An R—Fe—B based rare-earth sintered magnet according to the present invention includes, as a main phase, crystal grains of an $R_2Fe_{14}B$ type compound that includes Nd, which is a light rare-earth element, as a major rare-earth element R. The magnet includes a heavy rare-earth element RH (which is at least one of Dy and Tb) that has been introduced through the surface of the sintered magnet by diffusion. The magnet has a region in which the concentration of the heavy rare-earth element RH in a grain boundary R-rich phase is lower than at the surface of the crystal grains of the $R_2Fe_{14}B$ type compound but higher than at the core of the crystal grains of the $R_2Fe_{14}B$ type compound.

In one preferred embodiment, if the concentration of Dy in the R—Fe—B based rare-earth sintered magnet is x (mass %) and if the temperature coefficient of an average coercivity $H_{cJ}$ from 20° C. through 140° C. is y (%/° C.), the magnet satisfies the inequality: $0.015\times x-0.57\leqq y\leqq 0.023\times x-0.50$.

In another preferred embodiment, if the concentrations of the heavy rare-earth elements Dy and Tb in the R—Fe—B based rare-earth sintered magnet are x1 (mass %) and x2 (mass %), respectively, and if the temperature coefficient of an average coercivity $H_{cJ}$ from 20° C. through 140° C. is y (%/° C.), the magnet satisfies the inequality: $0.015\times(x1+1.5\times x2)-0.57\leqq y\leqq 0.023\times(x1+1.5\times x2)-0.50$.

In still another preferred embodiment, the region is located at a depth of 100 μm under the surface of the sintered magnet body.

Effects of the Invention

An R—Fe—B based rare-earth sintered magnet according to the present inventions has, as a main phase, crystal grains of an $R_2Fe_{14}B$ type compound that includes Nd, which is a light rare-earth element, as a major rare-earth element R, and also has a heavy rare-earth element RH (which is at least one of Dy and Tb) that has been introduced through the surface of the sintered magnet by diffusion. That is why the magnet of the present invention has increased coercivity $H_{cJ}$. In addition, the magnet has a special kind of structure in which the concentration of the heavy rare-earth element RH in a grain boundary R-rich phase is lower than at the surface of the crystal grains of the $R_2Fe_{14}B$ type compound but higher than at the core of the crystal grains of the $R_2Fe_{14}B$ type compound. Consequently, the coercivity $H_{cJ}$ can be increased effectively even with a small amount of heavy rare-earth element RH added, and the temperature properties have been improved as well.

BRIEF DESCRIPTION OF DRAWINGS

FIG. 3(*b*) is a photograph showing a result of element Dy mapping that was carried out on Sample #1. And FIG. 3(*c*) is a photograph showing how the photograph shown in FIG. 3(*b*) will look in a broader field of view.

DESCRIPTION OF REFERENCE NUMERALS

Figure 1:
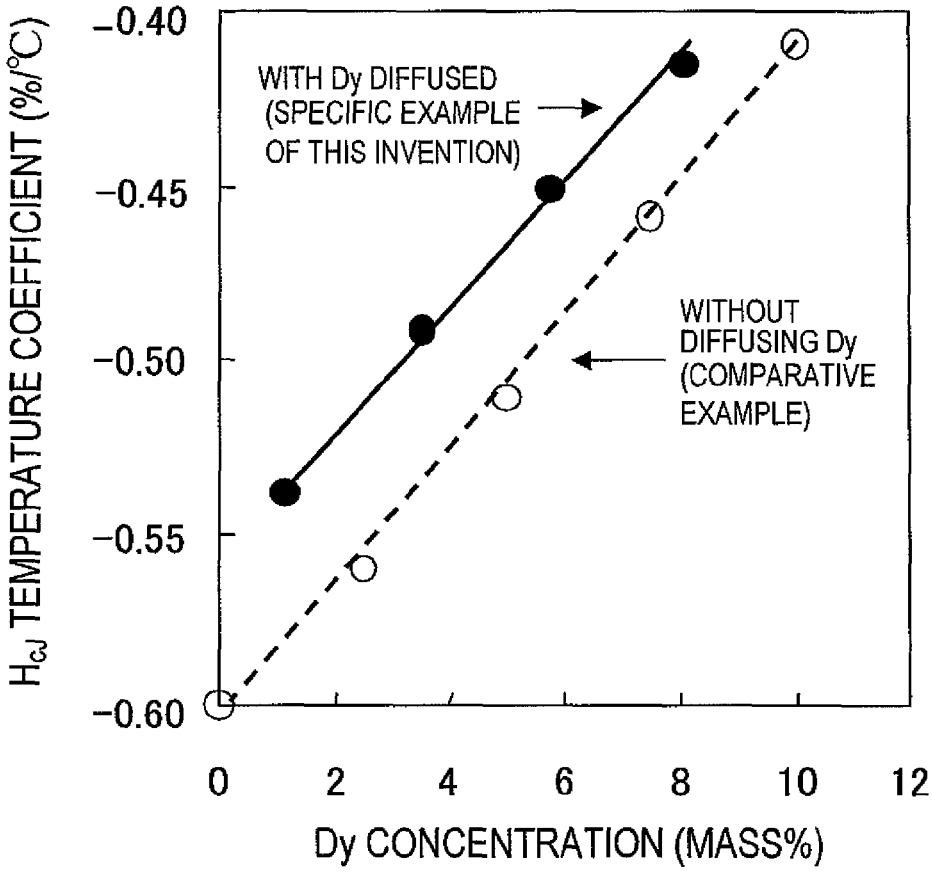
FIG. 1 is a graph showing how the temperature coefficient y of the coercivity changes with the Dy concentration x.

2 sintered magnet body
4 RH bulk body
6 processing chamber
8 net made of Nb

BEST MODE FOR CARRYING OUT THE INVENTION

The present inventors discovered that by diffusing a heavy rare-earth element RH (which is at least one of Dy and Tb) inside a sintered magnet body through its surface, the concentration distribution of the heavy rare-earth element RH could be optimized not only at the surface of crystal grains of an $R_2Fe_{14}B$ type compound that is the main phase that forms the structure of the sintered magnet body (which will be referred to herein as the "outer periphery (surface region) of the main phase grains") and at the core of those crystal grains (which will be referred to herein as the "core (inner region) of the main phase grains") but also in the grain boundary R-rich phase, and therefore, the temperature coefficient of the coercivity could be improved significantly even with a small amount of the heavy rare-earth element RH added.

As used herein, the "outer periphery (surface region) of the main phase grains" is a portion of the main phase crystal grains and is a layer in which the heavy rare-earth element RH, which has diffused through the surface of the sintered body and the grain boundary and then entered the main phase grain through the grain boundary, has had an increased concentration. On the other hand, the "core (inner region) of the main phase grains" means a portion of the main phase grains that is located inside of the outer periphery (surface region) of the main phase grains. In the grain boundary phase that is located between main phase grains, there are an "R-rich phase" and an "oxide phase". The "R-rich phase" is a phase including the rare-earth element R in a relatively high concentration in the grain boundary phase.

The R—Fe—B based rare-earth sintered magnet of the present invention has, as its main phase, crystal grains of an $R_2Fe_{14}B$ type compound that includes Nd, which is a light rare-earth element RL, as a major rare-earth element R. However, this magnet also includes the heavy rare-earth element RH that has been introduced there through the surface of the sintered magnet by diffusion. Also, the sintered magnet of the present invention has a region in which the concentration of the heavy rare-earth element RH in the R-rich phase is lower than in the outer periphery (surface region) of the main phase grains but higher than at the core (inner region) of the main phase grains. The greater the percentage of such a region to the entire sintered magnet, the better. But it is sufficiently effective if the thickness of that region is at least approximately 2% of the average thickness of the sintered magnet. Preferably, the thickness of that region is 5% or more of the average thickness of the sintered magnet.

Such a structure is preferably realized by a method that makes the grain boundary diffusion advance more preferentially than the volume diffusion into the main phase grains (which will be referred to herein as "intragrain diffusion") as will be described later. According to a conventional method that uses a material alloy powder including a heavy rare-earth element RH, the heavy rare-earth element RH will be included substantially uniformly in the main phase, and therefore, the concentration of the heavy rare-earth element RH is never higher in the outer periphery (surface region) of the main phase grains than at the core (inner region) of the main phase grains. Also, even according to the method disclosed in Patent Document No. 5 in which a Dy film is deposited on the surface of a sintered magnet body and then Dy is diffused from the Dy film into the sintered body through heat treatment, Dy will also be included in a high concentration in the grain boundary phase. That is why the concentration of the heavy rare-earth element RH never becomes higher in the outer periphery (surface region) of the main phase grains than in the R-rich phase, either.

According to the present invention, by causing the heavy rare-earth element RH in the grain boundary phase to have an increased concentration in the outer periphery (surface region) of the main phase grains by utilizing high affinity of the main phase to the heavy rare-earth element RH, the concentration of the heavy rare-earth element RH is increased in the outer periphery (surface region) of the main phase grains rather than in the grain boundary R-rich phase. Such a structure is preferably realized by significantly reducing the amount of the heavy rare-earth element RH to be supplied onto the surface of the sintered magnet body compared to the conventional techniques and by quickly moving the heavy rare-earth element RH that has been introduced into the grain boundary phase to the outer periphery (surface region) of the main phase grains. In this case, the grain boundary functions as only a passage for moving the heavy rare-earth element RH toward the inner portion of the sintered magnet body quickly. Also, if a technique for depositing a film of the heavy rare-earth element RH on the surface of the sintered magnet body is adopted, the structure of the present invention can also be realized by introducing another metallic element, which will promote the grain boundary diffusion, into the grain boundary phase as will be described later.

The R—Fe—B based rare-earth sintered magnet of the present invention having such a structure can improve the temperature coefficient of the coercivity $H_{cJ}$. In this case, the average temperature coefficient of the coercivity $H_{cJ}$ from 20° C. through 140° C. is identified by y (%/° C.). This temperature coefficient y is defined by the following Equation (1):

$$y = \frac{H_{cJ}(20°\ C.) - H_{cJ}(140°\ C.)}{20 - 140} \times \frac{1}{H_{cJ}(20°\ C.)} \times 100 \quad (1)$$

where $H_{cJ}$(T ° C.) is the coercivity $H_{cJ}$ at a temperature T ° C.

Supposing the R—Fe—B based rare-earth sintered magnet has Dy in a concentration x (mass %), the temperature coefficient y of the coercivity $H_{cJ}$ can be approximated by a linear function of the Dy concentration x as represented by the following Equation (2):

$$y = a \times x + b \quad (2)$$

where a and b are both constants but have different values according to the composition or structure of the magnet.

In a normal R—Fe—B based rare-earth sintered magnet, a is a positive number, b is a negative number, and the temperature coefficient y of the coercivity $H_{cJ}$ has a negative value.

FIG. 1 is a graph showing how the temperature coefficient y of the coercivity $H_{cJ}$ changes with the Dy concentration x. In this graph, the solid line represents the data that was collected about specific examples of the present invention, while the broken line represents the data that was collected about comparative examples that had been made with Dy added to the material alloy from the beginning.

As can be seen from FIG. 1, the higher the Dy concentration x, the greater the temperature coefficient y and the smaller its absolute value. That is to say, as the Dy concentration x increases, the decrease in coercivity $H_{cJ}$ can be checked more thoroughly even at elevated temperatures, and therefore, the thermal resistance of the magnet can be increased more significantly.

Comparing the specific examples of the present invention to the comparative examples shown in FIG. 1, it can be seen that at the same Dy concentration x, the temperature coefficient y was higher in a specific example of the present invention than in a comparative example. In other words, to achieve the same temperature coefficient y, specific examples of the present invention need a lower Dy concentration than comparative examples. This is an effect achieved because Dy is included in an increased concentration in the outer periphery (surface region) of the main phase grains according to the present invention, and this indicates that Dy is used more efficiently according to the present invention. That is to say, this means that in comparative examples, Dy is also included a lot at the core (inner region) of the main phase grains and in the grain boundary (i.e., R-rich phases or oxide phases) but hardly contributes to increasing the coercivity $H_{cJ}$.

The present inventors discovered and confirmed via experiments that as for the temperature coefficient y of the coercivity $H_{cJ}$ of the R—Fe—B based rare-earth sintered magnet of the present invention, the constants a and b of Equation (2) would fall within the ranges defined by the following Inequalities (3):

$$0.015 \leqq a \leqq 0.023,\ -0.57 \leqq b \leqq 0.50 \quad (3)$$

Since the constants a and b satisfy these Inequalities (3), the temperature coefficient y of the coercivity $H_{cJ}$ can satisfy the following Inequality (4):

$$0.015 \times x - 0.57 \leqq y \leqq 0.023 \times x - 0.50 \quad (4)$$

Furthermore, supposing the R—Fe—B based rare-earth sintered magnet has the heavy rare-earth elements Dy and Tb in concentration x1 and x2 (mass %), respectively, the temperature coefficient y of the coercivity $H_{cJ}$ can satisfy the following Inequality (5):

$$0.015 \times (x1 + 1.5 \times x2) - 0.57 \leqq y \leqq 0.023 \times (x1 + 1.5 \times x2) - 0.50 \quad (5)$$

If the heavy rare-earth element RH is included in the same concentration, the lower limit of the temperature coefficient y represented by Inequalities (4) and (5) should be greater than the temperature coefficient of a conventional R—Fe—B based rare-earth sintered magnet. That is to say, according to the present invention, if the heavy rare-earth element RH is included in the same concentration x, the temperature coefficient y will be closer to zero (i.e., a more ideal state will be realized by the present invention).

The R—Fe—B based rare-earth sintered magnet of the present invention is produced preferably by supplying the heavy rare-earth element RH from a heavy rare-earth bulk body (which will be referred to herein as an "RH bulk body") to the surface of a sintered magnet body while diffusing the heavy rare-earth element RH deeper into the sintered body through the surface thereof at the same time.

In the manufacturing process of the present invention, a bulk body of a heavy rare-earth element RH that is not easily vaporizable (or sublimable) and a rare-earth sintered magnet body are heated to a temperature of 700° C. to 1,100° C., thereby reducing the vaporization (or sublimation) of the RH bulk body to the point that the growth rate of an RH film is not excessively higher than the rate of diffusion of RH into the magnet and diffusing the heavy rare-earth element RH, which has traveled to reach the surface of the sintered magnet body, into the magnet body quickly. It should be noted that to diffuse a heavy rare-earth element RH into a sintered magnet body from the surface thereof while simultaneously supplying the heavy rare-earth element RH from a heavy rare-earth bulk body (which will be referred to herein as an "RH bulk body") to the surface of a sintered magnet body as will be described later with respect to preferred embodiments of the present invention will be sometimes simply referred to herein as "evaporation diffusion". At such a temperature falling within the range of 700° C. to 1,100° C., the heavy rare-earth element RH hardly vaporizes (or sublimes) but the rare-earth element does diffuse actively in an R—Fe—B based rare-earth sintered magnet. For that reason, the grain boundary diffusion of the heavy rare-earth element RH into the magnet body can be accelerated preferentially than the film formation of the heavy rare-earth element RH on the surface of the magnet body. In this case, the temperature range is more preferably from 850° C. to less than 1,000° C.

In the prior art, it has been believed that to vaporize (or sublime) a heavy rare-earth element RH such as Dy, the magnet body should be heated to a rather high temperature and that it would be impossible to deposit Dy on the sintered magnet body just by heating it to a temperature as low as 700° C. to 1,100° C. Contrary to this popular belief, however, the results of experiments the present inventors carried out revealed that the heavy rare-earth element RH could still be supplied onto an opposing rare-earth magnet and diffused into it even at such a low temperature of 700° C. to 1,100° C.

According to the conventional technique of forming a film of a heavy rare-earth element RH (which will be referred to herein as an "RH film") on the surface of a sintered magnet body and then diffusing the element into the sintered magnet body by heat treatment, so-called "intragrain diffusion" will advance significantly in the surface region that is in contact with the RH film, thus introducing a lot of the heavy rare-earth element RH into the main phase grains and eventually decreasing the remanence $B_r$. On the other hand, according to the present invention, since the heavy rare-earth element RH is supplied onto the surface of the sintered magnet body with the growth rate of the RH film decreased and the temperature of the sintered magnet body is maintained at an appropriate level for diffusion, the "grain boundary diffusion" advances more preferentially than the "intragrain diffusion" even in the surface region of the sintered magnet body. That is to say, since the heavy rare-earth element RH does not reach the core of the main phases even in the vicinity of the surface region, the decrease in remanence $B_r$ can be minimized and the coercivity $H_{cJ}$ can be increased effectively.

The R—Fe—B based rare-earth sintered magnet has a nucleation type coercivity generating mechanism. Therefore, if the magnetocrystalline anisotropy is increased in the outer periphery of a main phase, the nucleation of reverse magnetic domains can be reduced in the vicinity of the grain boundary phase. As a result, the coercivity $H_{cJ}$ can be increased effectively as a whole. According to the present invention, the heavy rare-earth replacement layer can be formed in the outer periphery of the main phase not only in a surface region of the sintered magnet body but also deep inside the magnet. Consequently, the coercivity $H_{cJ}$ of the overall magnet increases sufficiently because the coercivity can be increased more effectively in the outer region of the magnet body to be affected significantly by a demagnetization field. Therefore, according to the present invention, even if the amount of the heavy rare-earth element RH such as Dy added is small, a magnet with a good temperature coefficient can still be obtained.

Considering the facility of evaporation diffusion, the cost and other factors, it is most preferable to use Dy as the heavy rare-earth element RH that replaces the light rare-earth element RL in the outer periphery of the main phase. However, the magnetocrystalline anisotropy of $Tb_2Fe_{14}B$ is higher than that of $Dy_2Fe_{14}B$ and is about three times as high as that of $Nd_2Fe_{14}B$. That is why if Tb is evaporated and diffused, the coercivity can be increased most efficiently without decreasing the remanence of the sintered magnet body. When Tb is used, the evaporation diffusion is preferably carried out at a higher temperature and in a higher vacuum than a situation where Dy is used.

As can be seen easily from the foregoing description, according to the present invention, the heavy rare-earth element RH does not always have to be added to the material alloy. That is to say, a known R—Fe—B based rare-earth sintered magnet, including a light rare-earth element RL (which is at least one of Nd and Pr) as the rare-earth element R, may be provided and the heavy rare-earth element RH may be diffused inward from the surface of the magnet. If only the conventional heavy rare-earth layer were formed on the surface of the magnet, it would be difficult to diffuse the heavy rare-earth element RH deep inside the magnet even at an elevated diffusion temperature. However, according to the present invention, by producing the grain boundary diffusion of the heavy rare-earth element RH, the heavy rare-earth element RH can be supplied efficiently to even the outer periphery (surface region) of the main phase grains that is located deep inside the sintered magnet body. The present invention is naturally applicable to an R—Fe—B based sintered magnet, to which the heavy rare-earth element RH was already added when it was a material alloy. However, if a lot of heavy rare-earth element RH were added to the material alloy, the effect of the present invention would not be achieved sufficiently. For that reason, a relatively small amount of heavy rare-earth element RH may be added in that early stage.

According to the present invention, the concentration of the RH to be introduced by diffusion preferably accounts for 0.05 mass % to 1.5 mass % of the overall magnet. This range is preferred for the following reasons. Specifically, if the RH concentration exceeded 1.5 mass %, the decrease in remanence $B_r$ could be out of control. However, if the RH concentration were less than 0.05 mass %, then the coercivity $H_{cJ}$ could not be increased effectively.

Next, an example of a preferred diffusion process according to the present invention will be described with reference to FIG. 2, which illustrates an exemplary arrangement of sintered magnet bodies 2 and RH bulk bodies 4. In the example illustrated in FIG. 2, the sintered magnet bodies 2 and the RH bulk bodies 4 are arranged so as to face each other with a predetermined gap left between them inside a processing chamber 6 made of a refractory metal. The processing chamber 6 shown in FIG. 2 includes a member for holding a plurality of sintered magnet bodies 2 and a member for holding the RH bulk body 4. Specifically, in the example shown in FIG. 2, the sintered magnet bodies 2 and the upper RH bulk body 4 are held on a net 8 made of Nb. However, the sintered magnet bodies 2 and the RH bulk bodies 4 do not have to be held in this way but may also be held using any other member. Nevertheless, a member that closes the gap between the sintered magnet bodies 2 and the RH bulk bodies 4 should not be used.

By heating the processing chamber 6 with a heater (not shown), the temperature of the processing chamber 6 is raised. In this case, the temperature of the processing chamber 6 is controlled to the range of 700° C. to 1,100° C., more preferably to the range of 850° C. to less than 1,000° C. In such a temperature range, the heavy rare-earth element RH has a very low vapor pressure and hardly vaporizes. In the prior art, it has been commonly believed that in such a temperature range, a heavy rare-earth element RH, vaporized from an RH bulk body 4, be unable to be supplied and deposited on the surface of the sintered magnet body 2.

However, the present inventors discovered that by arranging the sintered magnet body 2 and the RH bulk body 4 close to each other, not in contact with each other, a heavy rare-earth metal could be supplied at as low a rate as several μm per hour (e.g., in the range of 0.5 μm/hr to 5 μm/hr) onto the surface of the sintered magnet body 2. We also discovered that by controlling the temperature of the sintered magnet body 2 within an appropriate range such that the temperature of the sintered magnet body 2 was equal to or higher than that of the RH bulk body 4, the heavy rare-earth element RH that had been supplied in vapor phase could be diffused deep into the sintered magnet body 2 as it was. This temperature range is a preferred one in which the heavy rare-earth element RH diffuses inward through the grain boundary phase of the sintered magnet body 2. As a result, slow supply of the heavy rare-earth element RH and quick diffusion thereof into the magnet body can be done efficiently.

According to the present invention, RH that has vaporized just slightly as described above is supplied at a low rate onto the surface of the sintered magnet body. For that reason, there is no need to heat the processing chamber to a high temperature or apply a voltage to the sintered magnet body or RH bulk body as in the conventional process of depositing a heavy rare-earth element RH by vapor phase deposition process.

The gap between the sintered magnet body 2 and the RH bulk body 4 is set to fall within the range of 0.1 mm to 300 mm. This gap is preferably 1 mm to 50 mm, more preferably 20 mm or less, and even more preferably 10 mm or less. As long as such a distance can be kept between them, the sintered magnet bodies 2 and the RH bulk bodies 4 may be arranged either vertically or horizontally or may even be moved relative to each other. Furthermore, since the vaporized RH can create a uniform RH atmosphere within the distance range defined above, the area of their opposing surfaces is not particularly limited but even their narrowest surfaces may face each other.

According to the present invention, the heavy rare-earth element RH can be supplied onto the surface of the magnet just by controlling the temperature of the overall processing chamber without using any special mechanism for vaporizing (or subliming) the evaporating material. As used herein, the "processing chamber" broadly refers to a space in which the sintered magnet bodies 2 and the RH bulk bodies 4 are arranged. Thus, the processing chamber may mean the processing chamber of a heat treatment furnace but may also mean a process vessel housed in such a processing chamber.

During the heat treatment process, an inert atmosphere is preferably maintained inside the processing chamber. As used herein, the "inert atmosphere" refers to a vacuum or an atmosphere filled with an inert gas. Also, the "inert gas" may be a rare gas such as argon (Ar) gas but may also be any other gas as long as the gas is not chemically reactive between the RH bulk body and the sintered magnet body. The pressure of the inert gas is reduced so as to be lower than the atmospheric pressure. If the pressure of the atmosphere inside the processing chamber were close to the atmospheric pressure, then the heavy rare-earth element RH could not be supplied easily from the RH bulk body to the surface of the sintered magnet body. However, since the amount of the heavy rare-earth element RH diffused is determined by the rate of diffusion from the surface of the magnet toward the inner portion thereof, it should be enough to lower the pressure of the atmosphere inside the processing chamber to $10^2$ Pa or less, for example. That is to say, even if the pressure of the atmosphere inside the processing chamber were further lowered, the amount of the heavy rare-earth element RH diffused (and eventually the degree of increase in coercivity) would not change significantly. The amount of the heavy rare-earth element RH diffused is more sensitive to the temperature of the sintered magnet body, rather than the pressure.

The surface state of the sintered magnet is as close to a metal state as possible to allow the heavy rare-earth element RH to diffuse and penetrate easily. For that purpose, the sintered magnet is preferably subjected to an activation treatment such as acid cleaning or blast cleaning in advance. According to the present invention, however, when the heavy rare-earth element RH vaporizes and gets supplied in an active state onto the surface of the sintered magnet body, the heavy rare-earth element RH will diffuse toward the inner portion of the sintered magnet body at a higher rate than the rate of forming a solid layer. That is why the surface of the sintered magnet body may also have been oxidized to a certain degree as is observed right after a sintering process or a cutting process.

The shape and size of the RH bulk bodies are not particularly limited. For example, the RH bulk bodies may have a plate shape or an indefinite shape (e.g., a stone shape). Optionally, the RH bulk bodies may have a lot of very small holes with diameters of several ten μm. The RH bulk bodies are preferably made of either a heavy rare-earth element RH or an alloy including two or more heavy rare-earth elements RH. Also, the higher the vapor pressure of the material of the RH bulk bodies, the greater the amount of RH that can be introduced per unit time and the more efficient. Oxides, fluorides and nitrides including a heavy rare-earth element RH have so low vapor pressures that evaporation diffusion hardly occurs under the conditions falling within these ranges of temperatures and degrees of vacuum. For that reason, even if the RH bulk bodies are made of an oxide, a fluoride or a nitride including the heavy rare-earth element RH, the coercivity cannot be increased effectively.

Another preferred embodiment of an R—Fe—B based rare-earth sintered magnet according to the present invention may also be produced by depositing a layer including a metallic element M (which will be referred to herein as an "M layer") and a layer including a heavy rare-earth element RH (which will be referred to herein as an "RH layer") in this order on the surface of an R—Fe—B based rare-earth sintered magnet body and then diffusing the metallic element M and the heavy rare-earth element RH inside the sintered magnet body through the surface thereof.

According to the present invention, the diffusion process is carried out by heating a sintered magnet body on the M layer and the RH layer have been deposited. As a result of that heating, the metallic element M, having the lower melting point, will diffuse inside the sintered body quickly through the grain boundary and then the heavy rare-earth element RH will diffuse inside the sintered magnet body through the grain boundary. Since the metallic element M diffuses earlier, the melting point of the grain boundary phase decreases. That is why compared to a situation where no M layer has been deposited, the "grain boundary diffusion" of the heavy rare-earth element RH will be promoted. Also, compared to a situation where no M layer has been deposited, the heavy rare-earth element RH can be diffused more efficiently inside the sintered magnet body even at a lower temperature. Thanks to these functions of the metallic element M, the "grain boundary diffusion" will advance more preferentially than the "intragrain diffusion" in the surface region of the sintered magnet body. As a result, the decrease in remanence $B_r$ can be minimized and the coercivity $H_{cJ}$ can be increased effectively.

According to the present invention, the temperature of the heat treatment to be carried out to diffuse the metallic element M is preferably defined to be equal to or higher than the melting point of the metal M but lower than 1,000° C. Optionally, to further promote the diffusion of the heavy rare-earth element RH after the metal M has been diffused sufficiently, the heat treatment temperature may be raised to an even higher temperature of 800° C. to less than 1,000° C., for example.

The mass of M to be deposited on the surface of the sintered magnet body is preferably adjusted to account for 0.05% to 1.0% of that of the entire magnet. This range is preferred for the following reasons. Specifically, if the mass of M accounted for less than 0.05% of that of the magnet, then the grain boundary diffusion could not be promoted effectively. However, if the mass of M accounted for more than 1.0% of that of the magnet, then the performance of the magnet might deteriorate.

The mass of RH to be deposited on the surface of the sintered magnet body is preferably adjusted to account for 0.05% to 1.5% of that of the entire magnet. This range is preferred for the following reasons. Specifically, if the mass of the RH layer accounted for less than 0.05% of that of the magnet, then there would be too small an amount of heavy rare-earth element RH to diffuse inside the magnet sufficiently. However, if the mass of the RH layer accounted for more than 1.5% of that of the magnet, then the intragrain diffusion would prevail and the remanence $B_r$ might decrease.

By such a method, the heavy rare-earth element RH is caused to diffuse inside the magnet through the surface and the grain boundary phase under the driving force that has been generated due to the heat of the atmosphere and the difference in RH concentration at the surface of the magnet. In that case, a portion of the light rare-earth element RL in the $R_2Fe_{14}B$ phase is replaced with the heavy rare-earth element RH. As a result, an R—Fe—B based rare-earth sintered magnet, in which there is a region where the concentration of the heavy rare-earth element RH decreases in the order of the outer periphery (surface region) of the main phase grains, the R-rich phase near the main phase, and the core (inner region) of the main phase grains, is obtained.

In this manner, by determining the composition so that the heavy rare-earth element RH has a preferred concentration, the temperature coefficient of the coercivity can be increased with a small amount of the heavy rare-earth element RH added.

Hereinafter, a preferred embodiment of a method for producing an R—Fe—B based rare-earth sintered magnet according to the present invention will be described.

Embodiment 1

First, an alloy including 25 mass % to 40 mass % of a rare-earth element R, 0.6 mass % to 1.6 mass % of B (boron) and Fe and inevitably contained impurities as the balance is provided. A portion (at most 10 mass %) of R may be replaced with a heavy rare-earth element RH, a portion of B may be replaced with C (carbon) and a portion (50 at % or less) of Fe may be replaced with another transition metal element such as Co or Ni. For various purposes, this alloy may contain about 0.01 mass % to about 1.0 mass % of at least one additive element A that is selected from the group consisting of Al, Si, Ti, V, Cr, Mn, Ni, Cu, Zn, Ga, Zr, Nb, Mo, Ag, In, Sn, Hf, Ta, W, Pb and Bi.

Such an alloy is preferably made by quenching a melt of a material alloy by strip casting process, for example. Hereinafter, a method of making a rapidly solidified alloy by strip casting will be described.

First, a material alloy with the composition described above is melted by induction heating within an argon atmosphere to make a melt of the material alloy. Next, this melt is kept heated at about 1,350° C. and then quenched by a single roller process, thereby obtaining a flake-like alloy block with a thickness of about 0.3 mm. Then, the alloy block thus obtained is pulverized into flakes with a size of 1 mm to mm before being subjected to the next hydrogen pulverization process. Such a method of making a material alloy by strip casting is disclosed in U.S. Pat. No. 5,383,978, for example.

Coarse Pulverization Process

Next, the material alloy block that has been coarsely pulverized into flakes is loaded into a hydrogen furnace and then subjected to a hydrogen decrepitation process (which will be sometimes referred to herein as a "hydrogen pulverization process") within the hydrogen furnace. When the hydrogen pulverization process is over, the coarsely pulverized alloy powder is preferably unloaded from the hydrogen furnace in an inert atmosphere so as not to be exposed to the air. This should prevent the coarsely pulverized powder from being oxidized or generating heat and would eventually minimize the deterioration of the magnetic properties of the resultant magnet.

As a result of this hydrogen pulverization process, the rare-earth alloy is pulverized to sizes of about 0.1 mm to several millimeters with a mean particle size of 500 μm or less. After the hydrogen pulverization, the decrepitated material alloy is preferably further crushed to finer sizes and cooled. If the material alloy unloaded still has a relatively high temperature, then the alloy should be cooled for a longer time.

Fine Pulverization Process

Next, the coarsely pulverized powder is finely pulverized with a jet mill pulverizing machine. A cyclone classifier is connected to the jet mill pulverizing machine for use in this preferred embodiment. The jet mill pulverizing machine is fed with the rare-earth alloy that has been coarsely pulverized in the coarse pulverization process (i.e., the coarsely pulverized powder) and gets the powder further pulverized by its pulverizer. The powder, which has been pulverized by the pulverizer, is connected to the cyclone classifier. The jet mill pulverizing machine is fed with the rare-earth alloy that has been coarsely pulverized in the coarse pulverization process (i.e., the coarsely pulverized powder) and gets the powder further pulverized by its pulverizer. The powder, which has been pulverized by the pulverizer, is then collected in a collecting tank by way of the cyclone classifier. In this manner, a finely pulverized powder with sizes of about 0.1 μm to about 20 μm (typically 3 μm to 5 μm) can be obtained. The pulverizing machine for use in such a fine pulverization process does not have to be a jet mill but may also be an attritor or a ball mill. Optionally, a lubricant such as zinc stearate may be added as an aid for the pulverization process.

Press Compaction Process

In this preferred embodiment, 0.3 wt % of lubricant is added to, and mixed with, the magnetic powder, obtained by the method described above, in a rocking mixer, for example, thereby coating the surface of the alloy powder particles with the lubricant. Next, the magnetic powder prepared by the method described above is compacted under an aligning magnetic field using a known press machine. The aligning magnetic field to be applied may have a strength of 1.5 to 1.7 tesla (T), for example. Also, the compacting pressure is set such that the green compact has a green density of about 4 g/cm$^3$ to about 4.5 g/cm$^3$.

Sintering Process

The powder compact described above is preferably sequentially subjected to the process of maintaining the compact at a temperature of 650° C. to 1,000° C. for 10 to 240 minutes and then to the process of further sintering the compact at a higher temperature (of 1,000° C. to 1,200° C., for example) than in the maintaining process. Particularly when a liquid phase is produced during the sintering process (i.e., when the temperature is in the range of 650° C. to 1,000° C.), the R-rich phase on the grain boundary phase starts to melt to produce the liquid phase. Thereafter, the sintering process advances to form a sintered magnet body eventually. The sintered magnet body can also be subjected to the evaporation diffusion process even if its surface has been oxidized as described above. For that reason, the sintered magnet body may be subjected to an aging treatment (at a temperature of 400° C. to 700° C.) or machined to adjust its size.

Evaporation Diffusion Process

Next, the heavy rare-earth element RH is made to diffuse and penetrate efficiently into the sintered magnet body thus obtained. More specifically, an RH bulk body, including the heavy rare-earth element RH, and a sintered magnet body are put into the processing chamber shown in FIG. 2 and then heated, thereby diffusing the heavy rare-earth element RH into the sintered magnet body while supplying the heavy rare-earth element RH from the RH bulk body onto the surface of the sintered magnet body. Optionally, after the diffusion process is over, an additional heat treatment process may be carried out. The additional heat treatment process may be carried out just by thermally treating the magnet with the partial pressure of Ar increased to about 500 Pa or more after the diffusion process such that the heavy rare-earth element RH will not vaporize. Alternatively, after the diffusion process has been finished once, only the heat treatment may be carried out without putting the RH bulk bodies. The processing temperature is preferably 700° C. to 1,100° C., more preferably 700° C. to less than 1,000° C., and even more preferably 800° C. to 950° C. If necessary, an aging treatment could be carried out at a temperature of 400° C. to 700° C. after the evaporation diffusion process has finished.

In the diffusion process of this preferred embodiment, the temperature of the sintered magnet body is preferably set equal to or higher than that of the bulk body. As used herein, when the temperature of the sintered magnet body is equal to or higher than that of the bulk body, it means that the difference in temperature between the sintered magnet body and the bulk body is within 20° C. Specifically, the temperatures of the RH bulk body and the sintered magnet body preferably both fall within the range of 700° C. to 1,100° C. Also, the gap between the sintered magnet body and the RH bulk body should be within the range of 0.1 mm to 300 mm, preferably 3 mm to 100 mm, and more preferably 4 mm to 50 mm, as described above.

Also, the pressure of the atmospheric gas during the evaporation diffusion process preferably falls within the range of $10^{-5}$ Pa to 500 Pa. Then, the evaporation diffusion process can be carried out smoothly with the vaporization (sublimation) of the RH bulk body advanced appropriately. To carry out the evaporation diffusion process efficiently, the pressure of the atmospheric gas preferably falls within the range of $10^{-3}$ Pa to 1 Pa. Furthermore, the amount of time for maintaining the temperatures of the RH bulk body and the sintered magnet body within the range of 700° C. to 1,100° C. is preferably 10 to 600 minutes. It should be noted that the "time for maintaining the temperatures" refers to a period in which the RH bulk body and the sintered magnet body have temperatures varying within the range of 700° C. to 1,100° C. and pressures varying within the range of $10^{-5}$ Pa to 500 Pa and does not necessarily refer to a period in which the RH bulk body and sintered magnet body have their temperatures and pressures fixed at a particular temperature and a particular pressure.

It should be noted that the bulk body does not have to be made of a single element but may include an alloy of a heavy rare-earth element RH and an element X, which is at least one element selected from the group consisting of Nd, Pr, La, Ce, Al, Zn, Sn, Cu, Co, Fe, Ag and In. Such an element X would lower the melting point of the grain boundary phase and would hopefully promote the grain boundary diffusion of the heavy rare-earth element RH.

In practice, the sintered magnet body that has gone through the evaporation diffusion process is preferably subjected to some surface treatment, which may be a known one such as Al evaporation, electrical Ni plating or resin coating. Before the surface treatment, the sintered magnet body may also be subjected to a known pre-treatment such as sandblast abrasion process, barrel abrasion process, etching process or mechanical grinding. Optionally, after the diffusion process, the sintered magnet body may be ground to have its size adjusted. Even after having gone through any of these processes, the coercivity can also be increased almost as effectively as always. For the purpose of size adjustment, the sintered magnet body is preferably ground to a depth of 1 μm to 300 μm, more preferably to a depth of 5 μm to 100 μm, and even more preferably to a depth of 10 μm to 30 μm.

Embodiment 2

The first half of a manufacturing process as a second preferred embodiment of the present invention, which includes the sintering and its preceding processing steps, is the same as that of the first preferred embodiment described above. Thus, the following description will be focused on only the process steps that are different from the first preferred embodiment described above.

Film Deposition+Diffusion Process

Optionally, instead of the evaporation diffusion process described above, an M layer and an RH layer may be deposited and then the diffusion process may be carried out.

First of all, a layer of a metal M and a layer of a heavy rare-earth element RH are deposited in this order on the surface of a sintered magnet body. The metal layer may be formed by any deposition process. For example, one of various thin-film deposition techniques such as a vacuum evaporation process, a sputtering process, an ion plating process, an ion vapor deposition (IND) process, an electrochemical vapor deposition (EVD) process and a dipping process may be adopted.

To diffuse the metal M from the metal layer and the heavy rare-earth element RH deeper inside the magnet, the heat treatment is preferably carried out at a temperature that is equal to or higher than the melting point of the metal M but less than 1,000° C. If necessary, the heat treatment may be carried out in two stages as described above. That is to say, first, the magnet may be heated to a temperature that is equal to or higher than the melting point of the metal M to promote the diffusion of the metal M preferentially. After that, heat treatment may be performed to cause the diffusion of the heavy rare-earth element RH. In this case, Al is preferably used as the metal M.

By carrying out such a heat treatment, the metal M can promote the diffusion of the heavy rare-earth element RH. That is to say, with the metal M, the heavy rare-earth element RH can diffuse more efficiently inside the magnet. As a result, with a small amount of the heavy rare-earth element RH added, not only the coercivity but also the temperature coefficient can be increased at the same time.

EXAMPLES

Example 1

First of all, alloys were prepared by strip casting process so as to have the compositions shown in the following Table 1 (in which the unit is mass %), thereby making thin alloy flakes with a thickness of 0.2 mm to 0.3 mm.

TABLE 1

| Sample | Nd | Dy | B | Co | Al | Cu | Fe |
|---|---|---|---|---|---|---|---|
| 1 | 32.0 | 0 | 1.00 | 0.90 | 0.15 | 0.10 | Bal. |
| 2 | 29.5 | 2.5 | | | | | |
| 3 | 27.0 | 5.0 | | | | | |
| 4 | 24.5 | 7.5 | | | | | |
| 5 | 22.0 | 10.0 | | | | | |
| 6 | 31.5 | 0.5 | 1.00 | 0.90 | 0.15 | 0.10 | Bal. |
| 7 | 29.0 | 3.0 | | | | | |
| 8 | 26.5 | 5.5 | | | | | |
| 9 | 24.0 | 8.0 | | | | | |
| 10 | 21.5 | 10.5 | | | | | |

Next, a container was loaded with those thin alloy flakes and then introduced into a hydrogen pulverizer, which was filled with a hydrogen gas atmosphere at a pressure of 500 kPa. In this manner, hydrogen was absorbed into the thin alloy flakes at room temperature and then desorbed. By performing such a hydrogen process, the thin alloy flakes were decrepitated to obtain a powder in indefinite shapes with sizes of about 0.15 mm to about 0.2 mm.

Thereafter, 0.05 wt % of zinc stearate was added as an aid for pulverization to the coarsely pulverized powder obtained by the hydrogen process and then the mixture was pulverized with a jet mill to obtain a fine powder with a size of approximately 3 μm.

The fine powder thus obtained was compacted with a press machine to make a powder compact. More specifically, the powder particles were pressed and compacted while being aligned with a magnetic field applied. Thereafter, the powder compact was unloaded from the press machine and then subjected to a sintering process at 1,020° C. for four hours in a vacuum furnace, thus obtaining sintered blocks, which were then machined and cut into sintered magnet bodies with a thickness of 3 mm, a length of 10 mm and a width of 10 mm.

Figure 2:
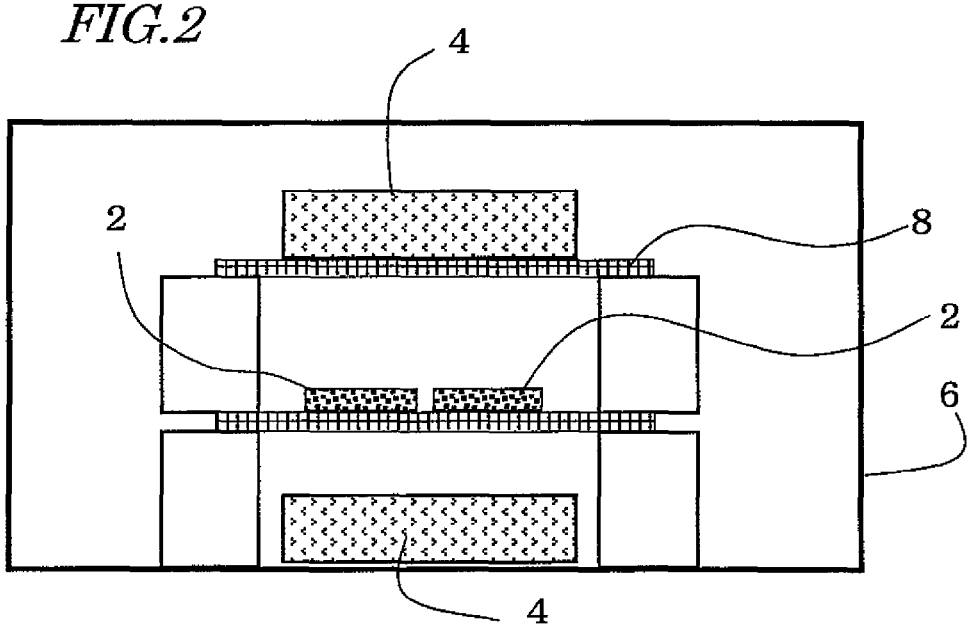
FIG. 2 is a cross-sectional view schematically illustrating the configuration of a process vessel that is preferably used to perform the process of producing an R—Fe—B based rare-earth sintered magnet according to the present invention along with an exemplary arrangement of RH bulk bodies and sintered magnet bodies in the process vessel.

The sintered magnet bodies represented by Samples #1 to #5 shown in Table 1 were acid-cleaned with a 0.3% nitric acid aqueous solution, dried, and then arranged in a process vessel with the configuration shown in FIG. 2. The process vessel for use in this preferred embodiment was made of Mo and included a member for holding a plurality of sintered magnet bodies and a member for holding two RH bulk bodies. A gap of about 5 mm to about 9 mm was left between the sintered magnet bodies and the RH bulk bodies. The RH bulk bodies were made of Dy with a purity of 99.9% and had dimensions of 30 mm×30 mm×5 mm.

Next, the process vessel shown in FIG. 2 was heated in a vacuum heat treatment furnace to conduct an evaporation diffusion process, which was carried out by raising the temperature under a pressure of $1\times10^{-2}$ Pa and maintaining the temperature at 900° C. for one to three hours so that the concentration of Dy introduced into each of those Samples #1 to #5 became 0.5 mass %. After the evaporation diffusion process, an aging treatment was carried out at 500° C. for 120 minutes under a pressure of 2 Pa.

Each of those samples #1 to #5 was magnetized with pulses with an intensity of 3 MA/m and then their magnet performance (including its remanence $B_r$ and coercivity $H_{cJ}$) was evaluated at 20° C. and 140° C. As for Samples #6 to #10, on the other hand, their magnet performance was evaluated by subjecting them to only an aging treatment, with no evaporation diffusion process performed. The results are shown in the following Table 2. The Dy concentrations were obtained as ICP analyzed values in both of the specific examples of the present invention and the comparative examples.

TABLE 2

| | Samples | Evaporation Diffusion | Dy concentration x (mass %) | HcJ (kA/m) 20° C. | HcJ (kA/m) 140° C. | Temperature coefficient y (%/° C.) of $H_{cJ}$ |
|---|---|---|---|---|---|---|
| Examples | 1 | YES | 0.5 | 1380 | 500 | −0.53 |
| | 2 | | 3.0 | 1810 | 745 | −0.49 |
| | 3 | | 5.5 | 2190 | 1010 | −0.45 |
| | 4 | | 8.0 | 2520 | 1270 | −0.41 |
| | 5 | | 10.5 | 2850 | 1560 | −0.38 |
| Comp. examples | 6 | NO | 0.5 | 1070 | 325 | −0.58 |
| | 7 | | 3.0 | 1480 | 520 | −0.54 |
| | 8 | | 5.5 | 1880 | 750 | −0.50 |
| | 9 | | 8.0 | 2250 | 1010 | −0.46 |
| | 10 | | 10.5 | 2600 | 1260 | −0.43 |

As can be seen from Table 2, Samples #1 to #5, which had been subjected to the evaporation diffusion process of the present invention, had much higher coercivities $H_{cJ}$ than Comparative Examples #6 to #10. Also, at the same Dy concentration, the coercivity had an increased temperature coefficient. As a result, the coercivity at 140° C. increased. However, supposing the heat treatment conditions are the same, if the concentration of Dy increases in the sintered magnet body yet to be subjected to the evaporation diffusion process, then the amount of Dy to diffuse will decrease. As a result, the magnitude of the increase in coercivity $H_{cJ}$ or temperature coefficient will be smaller than samples including Dy in lower concentrations. However, the present inventors discovered and confirmed via additional experiments that even in a sintered magnet body including a lot of Dy, the magnitude of increase could be no smaller than the one including Dy a little by optimizing the process time and temperature.

Meanwhile, using DF-STEM (specifically, CM200 produced by FEI and Genesis 2000 produced by Edax), it was estimated how much Dy diffused inside the magnet. In this case, to eliminate the influence of Fe according to the EDX process, Dy was observed with an mα ray, not Lα ray.

Figure 3:
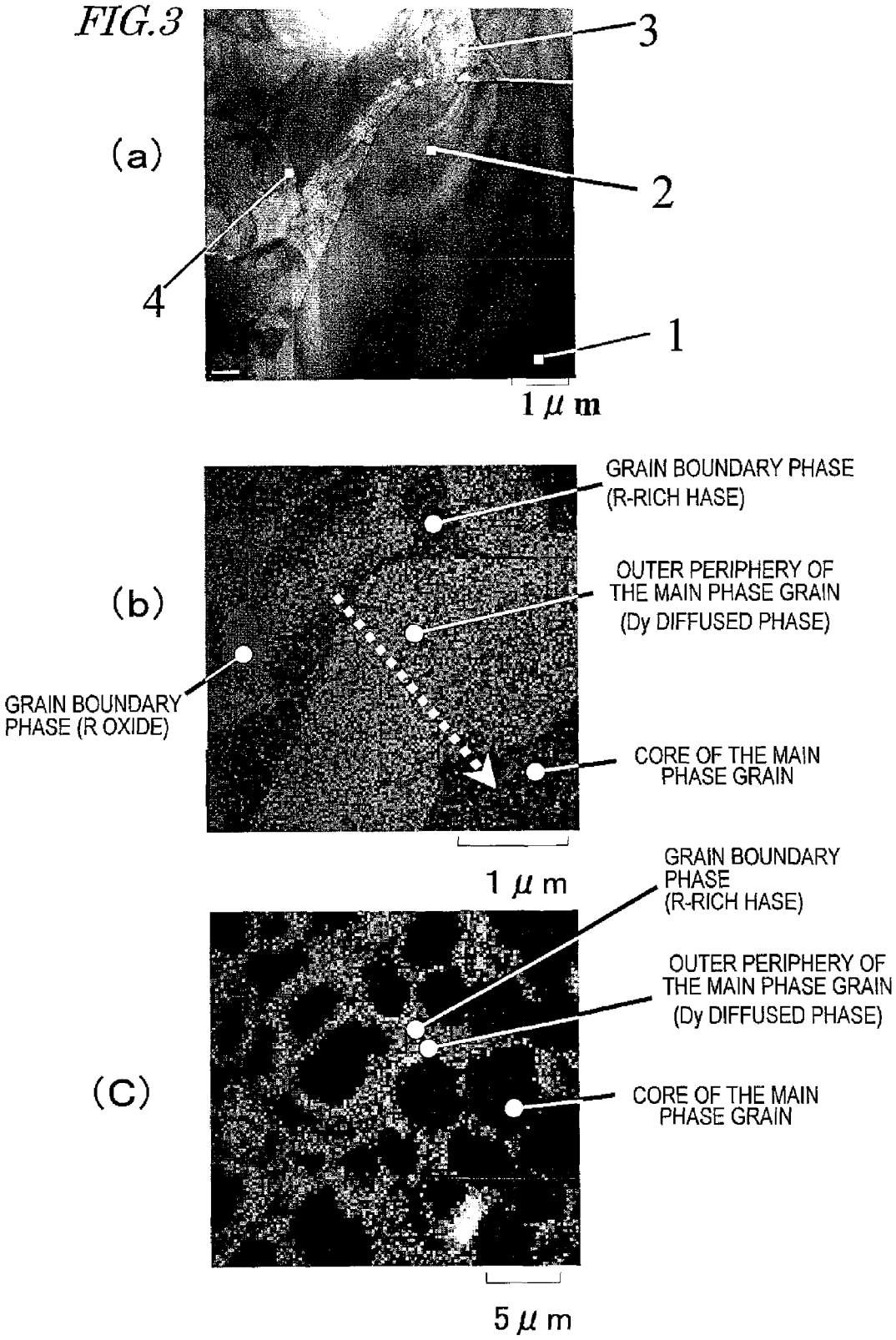
FIG. 3(*a*) is a TEM photograph showing a cross section of Sample #1 representing a specific example of the present invention.

FIG. 3(*a*) is a TEM photograph showing a cross section of a sintered magnet body representing Sample #1 at a depth of 100 μm under the surface, while FIG. 3(*b*) is a photograph showing a result of mapping the element Dy to that region. In FIG. 3(*a*), Points #1, #2, #3 and #4 represent the sites of a core (inner region) of the main phase grains, a outer periphery (surface region) of the main phase grains, an R-rich phase, and an R oxide phase. And FIG. 3(*c*) is a photograph showing how the photograph shown in FIG. 3(*b*) will look in a broader field of view. It can be seen that as for Sample #1, Dy is not located at the core (inner region) of the main phase grains but distributed in the outer periphery (surface region) of the main phase grains and the R-rich phase.

The present inventors also obtained a map of the element Dy at a depth of 300 μm under the surface of the sintered magnet body representing Sample #1. As a result, we also confirmed that the concentration of Dy decreased in the order of the R oxide phase, the outer periphery (surface region) of the main phase grains, the R-rich phase and the core (inner region) of the main phase grains as in FIG. 3(*b*).

The Dy concentrations were measured at respective sites in Samples #1 and #3. The results are shown in the following Table 3:

TABLE 3

| | Dy concentration x (mass %) | | | |
|---|---|---|---|---|
| | outer periphery (surface region) of the main phase grains | core (inner region) of the main phase grains | R-rich phase | R oxide phase |
| Sample 1 | 10.0 | 0.2 | 2.9 | 15.5 |
| Sample 3 | 14.6 | 5.3 | 6.9 | 19.0 |

It can be seen from this Table 3 that according to the present invention, Dy is distributed so that its concentrations at respective sites satisfy the inequality:

R oxide phase>outer periphery (surface region) of the main phase grains>R-rich phase>core (inner region) of the main phase grains By diffusing the heavy rare-earth element RH through the surface of a sintered magnet body and distributing it so that the respective constituent phases of the magnet form a preferred concentration profile, the temperature coefficient of the coercivity can be increased, and an R—Fe—B based rare-earth sintered magnet with good thermal resistance can be obtained, even with a small amount of heavy rare-earth element RH added to the entire magnet.

Example 2

An alloy was prepared by strip casting process so as to have a composition consisting of 26.0 mass % of Nd, 6.0 mass % of Pr, 1.00 mass % of B, 0.9 mass % of Co, 0.1 mass % of Cu, 0.2 mass % of Al and Fe as the balance, thereby making thin alloy flakes with thicknesses of 0.2 mm to 0.3 mm.

Next, a container was loaded with those thin alloy flakes and then introduced into a hydrogen pulverizer, which was filled with a hydrogen gas atmosphere at a pressure of 500 kPa. In this manner, hydrogen was absorbed into the thin alloy flakes at room temperature and then desorbed. By performing such a hydrogen process, the thin alloy flakes were decrepitated to obtain a powder in indefinite shapes with sizes of about 0.15 mm to about 0.2 mm.

Thereafter, 0.05 wt % of zinc stearate was added as an aid for pulverizing the coarsely pulverized powder obtained by the hydrogen process and then the mixture was pulverized with a jet mill to obtain a fine powder with a size of approximately 3 μm.

The fine powder thus obtained was compacted with a press machine to make a powder compact. More specifically, the powder particles were pressed and compacted while being aligned with a magnetic field applied. Thereafter, the powder compact was subjected to a sintering process at 1,020° C. for four hours in a vacuum furnace, thus obtaining sintered blocks, which were then machined and cut into sintered magnet bodies with a thickness of 3 mm, a length of 10 mm and a width of 10 mm.

Subsequently, a metal layer was deposited on the surface of the sintered magnet bodies using a magnetron sputtering apparatus. Specifically, the following process steps were carried out.

First, the deposition chamber of the sputtering apparatus was evacuated to reduce its pressure to $6\times10^{-4}$ Pa, and then was supplied with high-purity Ar gas with its pressure maintained at 1 Pa. Next, an RF power of 300 W was applied between the electrodes of the deposition chamber, thereby performing a reverse sputtering process on the surface of the sintered magnet bodies for five minutes. This reverse sputtering process was carried out to clean the surface of the sintered magnet bodies by removing a natural oxide film from the surface of the magnets.

Subsequently, Al particles were sputtered out of the surface of an Al target to deposit an Al layer to a thickness of 1.0 μm on the surface of the sintered magnet bodies. Thereafter, Dy particles were sputtered out of the surface of a Dy target to deposit a Dy layer to a thickness of 4.5 μm on the Al layer. In this manner, Sample #11 representing a specific example of the present invention was obtained.

On the other hand, Sample #12 representing a comparative example was made in the same way as Sample #11 except that a DC power of 500 W and an RF power of 30 W were applied between the electrodes of the deposition chamber to cause sputtering on the surface of the Dy target and depositing a Dy layer to a thickness of 4.5 μm on the surface of the sintered magnet bodies.

Next, the sintered magnet bodies, including the stack of these metal films on the surface, were subjected to a heat treatment process at 900° C. for 120 minutes within a reduced-pressure atmosphere of $1\times10^{-2}$ Pa. This heat treatment processes was carried out to diffuse the metallic elements from the stack of the metal films deeper inside the sintered magnet bodies through the grain boundary. Thereafter, the sintered magnet bodies were subjected to an aging treatment at 500° C. for two hours at 1 Pa. Meanwhile, Sample #13 representing another comparative example was also made by subjecting the sintered magnet bodies to only an aging treatment at 500° C. for two hours at 1 Pa without depositing the metal film of the element M.

These samples were magnetized with a pulsed magnetizing field with a strength of 3 MA/m and then their magnet performances (including remanence $B_r$ and coercivity $H_{cJ}$) were evaluated at 20° C. and 140° C. The magnetic properties (including coercivity $H_{cJ}$ and temperature coefficient) of Sample #11 representing a specific example of the present invention and Samples #12 and #13 representing comparative examples are shown in the following Table 4:

TABLE 4

| | 1st layer (M layer) | | | 2nd layer (RH layer) | | | | |
|---|---|---|---|---|---|---|---|---|
| Sample | Element | Thickness (μm) | Added in (mass %) | Element | Thickness (μm) | Added in (mass %) | HcJ (kA/m) | Temperature coefficient (%/° C.) |
| 11 (example) | Al | 1.0 | 0.07 | Dy | 4.5 | 0.3 | 1430 | −0.55 |
| 12 (comp. example) | | | | Dy | 4.5 | 0.3 | 1320 | −0.57 |
| 13 (comp. example) | | | | | | | 1010 | −0.61 |

As can be seen easily from this Table 4, it was confirmed that by depositing an Al layer inside the Dy layer and diffusing Al, the coercivity $H_{cJ}$ and the temperature coefficient both increased compared to a situation where only Dy was deposited.

Such advantageous effects were achieved probably because the diffusion of Dy would have been promoted by Al and because Dy would have permeated selectively through the grain boundary layer in the vicinity of the main phase inside the magnet. Thus, the present inventors discovered that even if a low-melting metal M (which is at least one element selected from the group consisting of Al, Ga, In, Sn, Pb, Bi, Zn and Ag) was deposited as the first layer, similar effects could also be achieved.

Example 3

First of all, alloys were prepared by strip casting process so as to have the compositions shown in the following Table 5 (in which the unit is mass %), thereby making thin alloy flakes with a thickness of 0.2 mm to 0.3 mm.

TABLE 5

| Sample | Nd | Dy | Tb | B | Co | Al | Cu | Fe |
|---|---|---|---|---|---|---|---|---|
| 21 | 30.0 | 0 | 2 | 1.00 | 0.90 | 0.15 | 0.10 | Bal. |
| 22 | 27.0 | 0 | 5 | | | | | |
| 23 | 29.0 | 3 | 0 | | | | | |
| 24 | 24.5 | 7.5 | 0 | | | | | |

Next, a container was loaded with those thin alloy flakes and then introduced into a hydrogen pulverizer, which was filled with a hydrogen gas atmosphere at a pressure of 500 kPa. In this manner, hydrogen was absorbed into the thin alloy flakes at room temperature and then desorbed. By performing such a hydrogen process, the thin alloy flakes were decrepitated to obtain a powder in indefinite shapes with sizes of about 0.15 mm to about 0.2 mm.

Thereafter, 0.05 wt % of zinc stearate was added as an aid for pulverization to the coarsely pulverized powder obtained by the hydrogen process and then the mixture was pulverized with a jet mill to obtain a fine powder with a size of approximately 3 μm.

The fine powder thus obtained was compacted with a press machine to make a powder compact. More specifically, the powder particles were pressed and compacted while being aligned with a magnetic field applied. Thereafter, the powder compact was unloaded from the press machine and then subjected to a sintering process at a temperature of 1,020° C. to 1,040° C. for four hours in a vacuum furnace, thus obtaining sintered blocks, which were then machined and cut into sintered magnet bodies with a thickness of 3 mm, a length of 10 mm and a width of 10 mm.

The sintered magnet bodies represented by Samples #21 to #24 shown in Table 5 were acid-cleaned with a 0.3% nitric acid aqueous solution, dried, and then arranged in a process vessel with the configuration shown in FIG. 2. The process vessel for use in this preferred embodiment was made of Mo and included a member for holding a plurality of sintered magnet bodies and a member for holding two RH bulk bodies. A gap of about 5 mm to about 9 mm was left between the sintered magnet bodies and the RH bulk bodies. The RH bulk bodies were made of Dy with a purity of 99.9% and had dimensions of 30 mm×30 mm×5 mm.

Next, the process vessel shown in FIG. 2 was heated in a vacuum heat treatment furnace to conduct an evaporation diffusion process, which was carried out by raising the temperature under a pressure of $1\times10^{-2}$ Pa and maintaining the temperature at 900° C. for one to three hours so that the concentration of Dy introduced into each of those Samples #21 to #24 became 0.5 mass %. After the evaporation diffusion process, an aging treatment was carried out at 500° C. for 120 minutes under a pressure of 2 Pa.

Each of those samples #21 to #24 was magnetized with pulses with an intensity of 3 MA/m and then their magnet performance (including its remanence $B_r$ and coercivity $H_{cJ}$) was evaluated at 20° C. and 140° C. Additional samples were made of the same materials as comparative examples but were subjected to only an aging treatment with no Dy diffused therein. The results are shown in the following Table 6. The Dy and Tb concentrations were obtained as ICP analyzed values in both of the specific examples of the present invention and the comparative examples.

TABLE 6

| | Samples | Evaporation Diffusion | Dy (mass %) | Tb (mass %) | HcJ (kA/m) 20° C. | HcJ (kA/m) 140° C. | Temperature coefficient (%/° C.) |
|---|---|---|---|---|---|---|---|
| Examples | 211 | YES | 0.5 | 2 | 1830 | 770 | −0.48 |
| | 221 | | 0.5 | 5 | 2590 | 1300 | −0.41 |
| | 231 | | 3.5 | 0 | 1860 | 780 | −0.48 |
| | 241 | | 8.0 | 0 | 2520 | 1270 | −0.41 |
| Comp. examples | 212 | NO | 0 | 2 | 1520 | 530 | −0.54 |
| | 222 | | 0 | 5 | 2310 | 990 | −0.47 |
| | 232 | | 3.0 | 0 | 1480 | 520 | −0.54 |
| | 242 | | 7.5 | 0 | 2160 | 935 | −0.47 |

As can be seen from Table 6, Samples #211 to #241, which had been subjected to the evaporation diffusion process, had much higher coercivities $H_{cJ}$ than Comparative Examples #212 to #242, no matter how much Dy or Tb was included there. The present inventors also confirmed that if the amount of Tb was multiplied by the factor of 1.5 and if the results were compared to (Dy+1.5Tb) (mass %), the temperature coefficients were almost the same as a situation where only Dy was added as in Samples #231 and #241.

Also, as for Sample #1, a map of the element Dy was obtained from a depth of 100 μm under the surface of the sintered magnet body. As a result, the present inventors confirmed that the Dy concentration decreased in the order of the R oxide phase, the outer periphery (surface region) of the main phase grains, the R-rich phase, and the core (inner region) of the main phase grains as in FIG. 3(*b*).

INDUSTRIAL APPLICABILITY

According to the present invention, main phase crystal grains, in which a heavy rare-earth element RH has had its concentration increased efficiently in the outer periphery thereof, can be produced efficiently even deep inside a sintered magnet body. As a result, a rare-earth magnet, which still has a high temperature coefficient and good thermal resistance even if the concentration of the heavy rare-earth element RH is reduced, is provided. Consequently, the magnet of the present invention can be used effectively in EPS and HEV motors, which will be in growing demand in the near future.

The invention claimed is:

1. An R—Fe—B based rare-earth sintered magnet comprising, as a main phase, crystal grains of an $R_2Fe_{14}B$ type compound that includes Nd, which is a light rare-earth element, as a major rare-earth element R, wherein the magnet includes a heavy rare-earth element RH (which is at least one of Dy and Tb) that has been introduced through the surface of the sintered magnet by diffusion, and wherein the magnet has a region in which the concentration of the heavy rare-earth element RH in a grain boundary R-rich phase is lower than at the surface of the crystal grains of the $R_2Fe_{14}B$ type compound but higher than at the core of the crystal grains of the $R_2Fe_{14}B$ type compound.

2. The R—Fe—B based rare-earth sintered magnet of claim 1, wherein if the concentration of Dy in the R—Fe—B based rare-earth sintered magnet is x (mass %) and if the temperature coefficient of an average coercivity $H_{cJ}$ from 20° C. through 140° C. is y (%/° C.), the magnet satisfies the inequality:

$$0.015\times x-0.57\leqq y\leqq 0.023\times x-0.50.$$

3. The R—Fe—B based rare-earth sintered magnet of claim 1, wherein if the concentrations of the heavy rare-earth elements Dy and Tb in the R—Fe—B based rare-earth sintered magnet are x1 (mass %) and x2 (mass %), respectively, and if the temperature coefficient of an average coercivity $H_{cJ}$ from 20° C. through 140° C. is y (%/° C.), the magnet satisfies the inequality:

$$0.015\times(x1+1.5\times x2)-0.57\leqq y\leqq 0.023\times(x1+1.5\times x2)-0.50.$$

4. The R—Fe—B based rare-earth sintered magnet of claim 1, wherein the region is located at a depth of 100 μm under the surface of the sintered magnet body.

* * * * *